US005190603A

United States Patent [19]

Nazmy et al.

[11] Patent Number: 5,190,603

[45] Date of Patent: Mar. 2, 1993

[54] PROCESS FOR PRODUCING A WORKPIECE FROM AN ALLOY CONTAINING DOPANT AND BASED ON TITANIUM ALUMINIDE

[75] Inventors: Mohamed Nazmy, Fislisbach; Markus Staubli, Dottikon, both of Switzerland

[73] Assignee: Asea Brown Boveri Ltd., Baden, Switzerland

[21] Appl. No.: 721,407

[22] Filed: Jun. 26, 1991

[30] Foreign Application Priority Data

Jul. 4, 1990 [EP] European Pat. Off. ..... 90112734.0

[51] Int. Cl.[5] ..... C22C 14/00

[52] U.S. Cl. ..... 148/671; 148/670; 420/418

[58] Field of Search ..... 148/421, 11.5 F, 671; 420/418

[56] References Cited

U.S. PATENT DOCUMENTS

| | | | |
|---|---|---|---|
| 4,836,983 | 6/1989 | Huang et al. | 420/418 |
| 4,842,817 | 6/1989 | Huang et al. | 420/418 |
| 4,842,819 | 6/1989 | Huang et al. | 420/418 |
| 4,842,820 | 6/1989 | Huang et al. | 420/418 |
| 4,849,168 | 7/1989 | Nishiyama et al. | 420/418 |
| 4,857,268 | 8/1989 | Huang et al. | 420/418 |
| 5,028,491 | 7/1991 | Huang et al. | 148/421 |
| 5,076,858 | 12/1991 | Huang | 148/11.5 F |
| 5,082,506 | 1/1992 | Huang | 148/2 |

FOREIGN PATENT DOCUMENTS

| | | |
|---|---|---|
| 0275391 | 7/1988 | European Pat. Off. . |
| 0349734 | 1/1990 | European Pat. Off. . |
| 2218526 | 9/1987 | Japan . |
| 0171862 | 7/1988 | Japan . |
| 9109697 | 7/1991 | World Int. Prop. O. . |

OTHER PUBLICATIONS

"Inermetallic Alloys Based on Gamma Titanium Aluminide", Young-Won Kim, JOM, Jul. 1989, pp. 24–30.

"Ordered Alloys—Physical Metallurgy and Structural Applications", Stoloff, International Metals Reviews, 1984, vol. 29, No. 3, pp. 123–135.

"Intermetallische Phasen", Sauthoff, Magazin Neue Werkstoffe, 1989, pp. 15–19.

*Primary Examiner*—Upendra Roy

*Attorney, Agent, or Firm*—Burns, Doane, Swecker & Mathis

[57] ABSTRACT

A process for producing a workpiece from an alloy containing dopant and based on titanium aluminide. The process is intended to produce a workpiece of high oxidation and corrosion resistance, good high-temperature strength and adequate ductility. The process steps include melting the alloy, casting the melt to produce a cast body, cooling the cast body to room temperature and removing its casting skin and its scale layer. The descaled cast body is subjected to high-temperature isostatic pressing at a temperature between 1200° and 1300° C. and a pressure between 100 and 150 MPa, and cooling the isostatically pressed cast body. The cooled cast body is heated to temperatures of 1050° to 1200° C., deformed isothermally one or more times at this temperature for the purpose of molding and structure improvement, and cooled to room temperature. The deformed cast body is machined to produce a workpiece by material removal.

7 Claims, 2 Drawing Sheets

PROCESS FOR PRODUCING A WORKPIECE FROM AN ALLOY CONTAINING DOPANT AND BASED ON TITANIUM ALUMINIDE

BACKGROUND OF THE INVENTION

1. Field of the Invention

The invention is based on a process for producing a workpiece from an alloy containing dopant and based on titanium aluminide.

High-temperature alloys for heat engines based on the intermetallic compound TiAl which are suitable for producing cast and forged components and which are capable of supplementing and in part replacing the conventional nickel-based superalloys.

The invention relates to the melting and casting of alloys produced from the intermetallic compound TiAl and doped with further additives and to the thermal and thermomechanical further processing to produce usable workpieces having good mechanical properties.

2. Discussion of Related Art

Intermetallic compounds of titanium with aluminum have some interesting properties which make them appear attractive as structural materials in the medium and higher temperature range. These include, inter alia, their low density compared with superalloys, which reaches only approximately ½ of the value for Ni superalloys. An obstacle to their technical usability in the present form is, however, their brittleness. The former can be improved by additives, with higher strength values also being achieved at the same time. Possible intermetallic compounds which are known as structural materials and have already been introduced in part are, inter alia, nickel aluminides, nickel silicides and titanium aluminides.

Attempts have already been made to improve the properties of pure TiAl by slightly altering the Ti/Al atomic ratio and by adding other elements by alloying. Further elements which have been proposed, for example, are, alternatively, Cr, B, V, Si, Ta, and also (Ni+Si) and (Ni+Si+B), and furthermore Mn, W, Mo, Nb and Hf. The intention was, on the one hand, to reduce the brittleness, i.e. to increase the malleability and toughness of the material and, on the other hand, to achieve as high a strength as possible in the temperature range of interest between room temperature and working temperature. In addition, a sufficiently high oxidation resistance was required. These objectives were, however, only partly achieved.

The high-temperature strength of the known aluminides, however, still leaves something to be desired. In accordance with the comparatively low melting point of these materials, the strength, in particular the creep strength in the upper temperature range is inadequate, as also emerges from publications in this connection.

Furthermore, the molding of intermetallic phases based on titanium aluminides presents certain problems. The high affinity of the elements involved for oxygen, in particular that of titanium, makes the production of moldings by casting difficult. Poor mold filling capacity, porosity and shrinkage cavities are the consequences. In addition, the properties of the as-cast structure cannot be improved to the desired extent by subsequent heat treatment. An obstacle to conventional hot deformation, on the other hand, is the comparatively imperfect ductility in the lower temperature range.

The following documents are cited in relation to the prior art:

N. S. Stoloff, "Ordered alloys—physical metallurgy and structural applications", International metals review, Vol. 29, No. 3, 1984, pages 123–135.

G. Sauthoff, "Intermetallische Phasen" ("Intermetallic Phases"), Werkstoffe zwischen Metall und Keramik, (Materials between metal and ceramic) Magazin neue Werkstoffe 1/89, pages 15–19.

Young-Won Kim, "Intermetallic Alloys based on gamma Titanium Aluminide", JOM, Jul. 1989.

U.S. Pat. No. 4,842,817

U.S. Pat. No. 4,842,819

U.S. Pat. No. 4,842,820

U.S. Pat. No. 4,857,268

U.S. Pat. No. 4,836,983

EP-A-0,275,391

The properties of the known modified intermetallic compounds and their conventional processing methods still do not in general satisfy the technical requirements in order to produce usable workpieces from them. This applies, in particular, in relation to the high-temperature strength and the toughness (ductility). There is therefore a need for further development and improvement of such materials and their molding, and also the beneficial influencing of the mechanical properties of the workpieces produced from them.

SUMMARY OF THE INVENTION

The invention provides a process for producing a workpiece from an alloy containing dopant and based on titanium aluminide, which process results in a material of high oxidation and corrosion resistance, good high-temperature strength and adequate ductility.

DESCRIPTION OF THE ILLUSTRATIVE EXAMPLES

Illustrative Example 1

Figure 1:
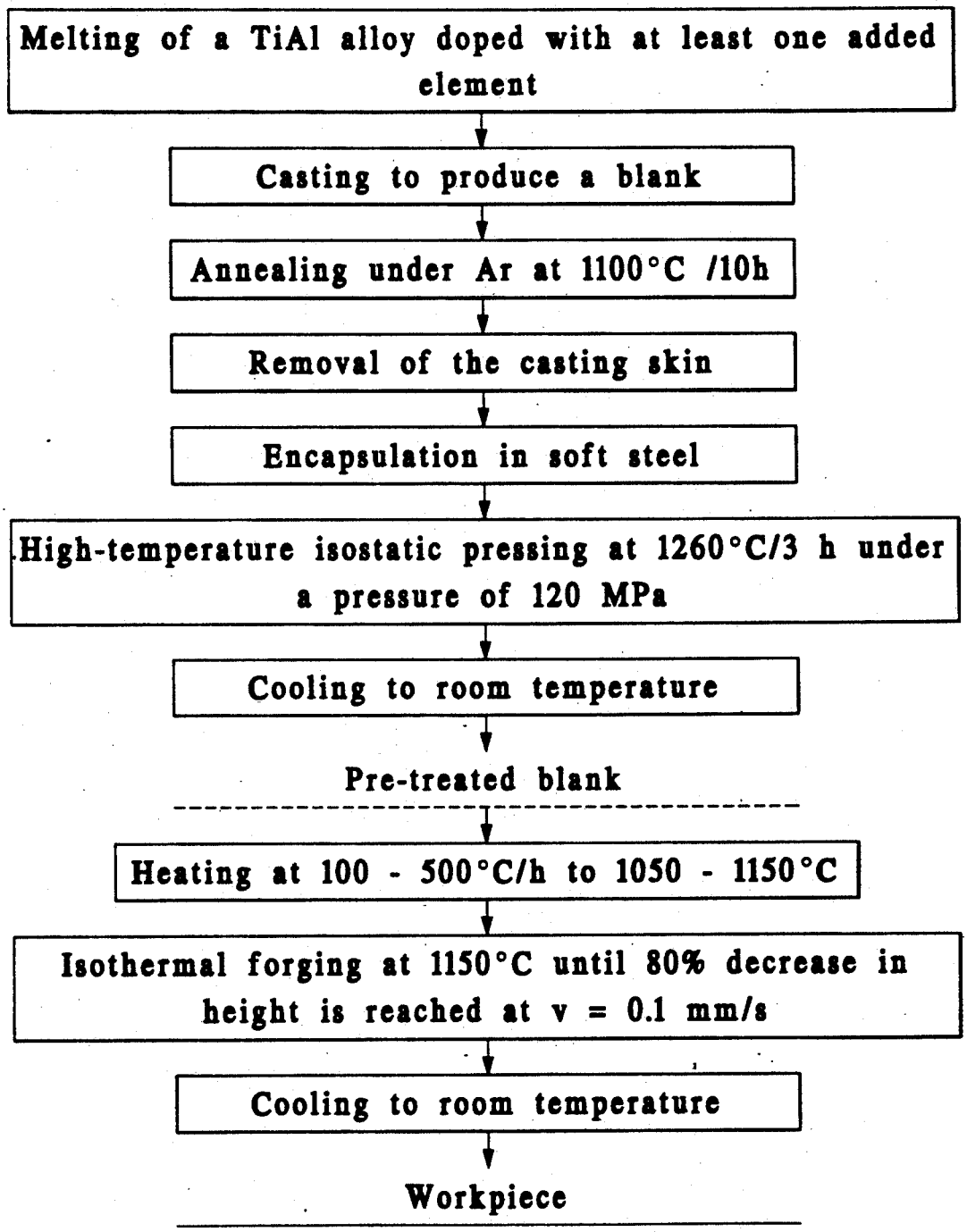
FIGS. 1 and 2 schematically illustrate the inventive process.
Figure 2:
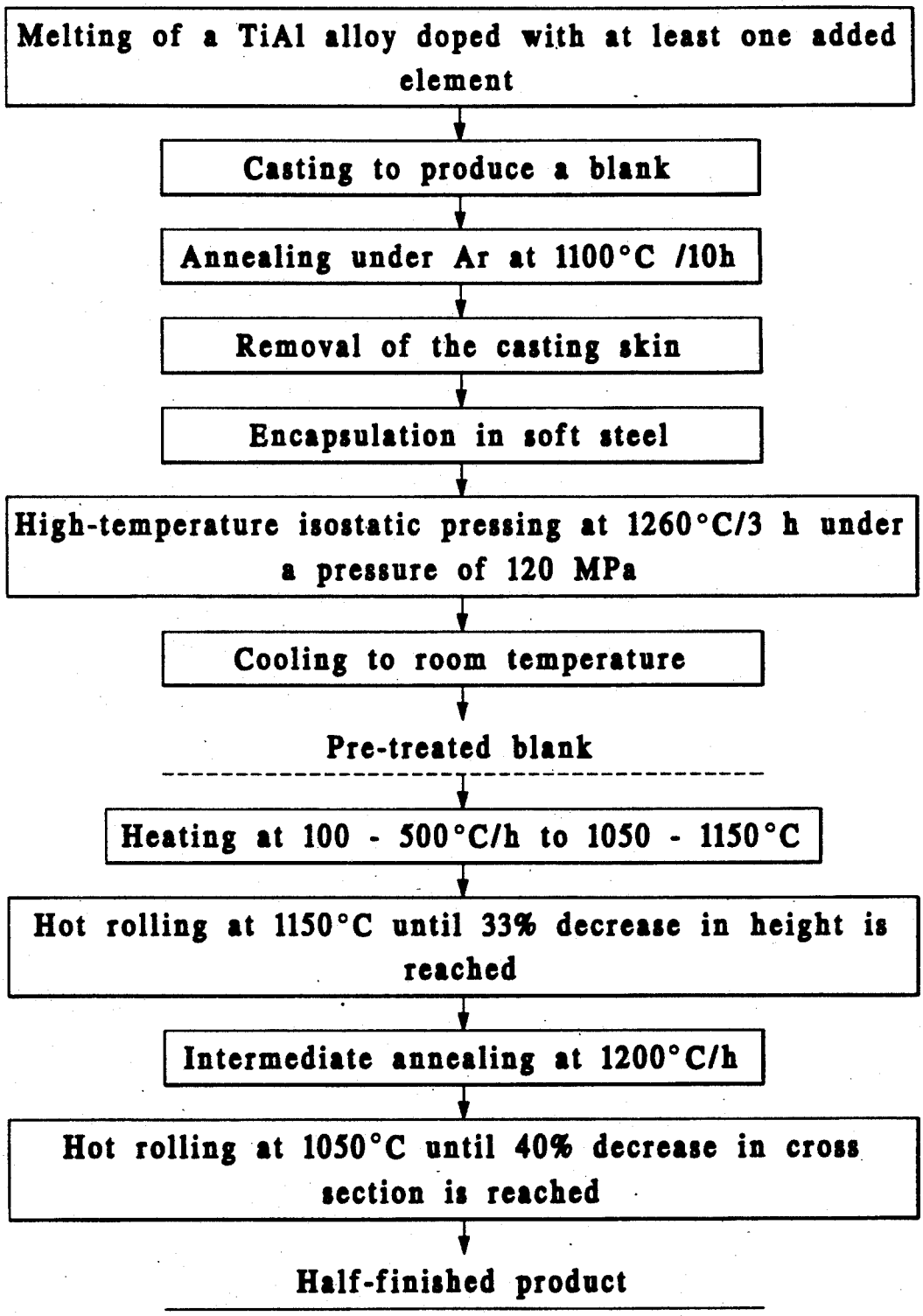

The following alloy was melted under an argon atmosphere in an induction furnace:

Al=48 atomic %

Y=3 atomic %

B=0.5 atomic %

Ti=remainder

The melt was cast to produce cast blocks measuring approximately 60 mm in diameter and approximately 60 mm in height. The cast blocks were then annealed for 10 h at a temperature of 1,100° C. in an argon atmosphere. The casting skin and the scale layer were then removed mechanically by desurfacing to a depth of approximately 1 mm. The cylindrical blocks were then pushed into suitable capsules made of soft carbon steel and the latter were closed in a leaktight manner by welding. The encapsulated workpieces were then subjected to high-temperature isostatic pressing at a temperature of 1,260° C. for 3 h under a pressure of 120 MPa, cooled, heated at 10° to 50° C./min to 1,100° C., held at this temperature and isothermally forged at 1,100° C. The tool used was composed of a molybdenum alloy having the following composition:

Ti=0.5% by weight

Zr=0.1% by weight

C=0.2% by weight

Mo=remainder

A yield point of the material to be forged of approximately 260 MPa at 1,100° C. was found. The deformation comprised an upsetting until the deformation was $\epsilon=1.3$, where $$\epsilon=\ln h_o/h$$

where $h_o$=original height of the workpiece, h=height of the workpiece after deformation.

The linear deformation velocity (ram velocity of forging press) v was 0.1 mm/s at the beginning of the forging process. The press forces required for the upsetting were of medium size. In the present case they were approximately 750 kN, which corresponded to an initial pressure of approximately 300 MPa.

This example demonstrated the excellent deformability of the pretreated material since the decrease in height during upsetting did, after all, amount to over 70% with freedom from cracks.

Illustrative Example 2

In accordance with the manner specified under Example 1, an alloy of the following composition was melted:

Al=48 atomic %

V=3 atomic %

Si=0.5 atomic %

Ti=remainder

The melt was cast to produce prismatic rolling ingots measuring 100 mm×80 mm×20 mm. These were first homogenized by annealing at approximately 1,100° C. and their casting skin was removed mechanically. After encapsulation and high-temperature isostatic pressing in accordance with Example 1, the ingots were hot-rolled at 1,150° C. The decrease in height (=decrease in cross section) was approximately 40%. It was not possible to detect any cracks on the rolled half-finished product, which indicates the excellent ductility of the material at this temperature. Sections of the rolled bar were upset at 1,150° C. with a ram velocity of approximately 0.1 mm/s by an amount which corresponded to an $\epsilon$ of 1.2 (decrease in height approximately 70%). The forging die was composed of the Mo alloy containing small amounts of Ti and Zr. The yield point of the workpiece was about 200 MPa at 1,150° C. After forging, the workpiece had a Vickers hardness HV of, on average, 336 kg/mm$^2$.

Illustrative Example 3

In accordance with Example 1, an alloy of the following composition was melted:

Al=48 atomic %

Ge=3 atomic %

Ti=remainder

The melt was cast to produce cast blocks measuring approximately 55 mm in diameter and 65 mm in height. The cast blocks were then annealed under an argon atmosphere for 10 h at a temperature of 1,100° C., cooled and mechanically machined to remove the casting skin. The annealing homogenized the alloy. Depending on the alloy composition, a suitable homogenization was achieved at temperatures between 1,000° and 1,150° C. and with annealing times between 1 and 30 hours. The cylindrical workpieces were then encapsulated, subjected to high-temperature isostatic pressing and forged at a temperature of 1,150° C. The deformation $\epsilon$ was 0.69 (decrease in height 50%) and the observed yield point was approximately 380 MPa. The deformation rate (ram velocity) was 0.1 mm/s.

Illustrative Example 4

A turbine bucket was produced from the following alloy:

Al=48 atomic %

Zr=4 atomic %

B=0.5 atomic %

Ti =48.5 atomic %

For this purpose, the above alloy was first melted from the elements and cast to produce a block measuring approximately 90 mm in diameter and approximately 250 mm in height. After an annealing operation at 1,050° C., the removal of the casting skin, encapsulation, high-temperature isostatic pressing etc., the block was first upset at 1,150° C. in the longitudinal direction in a manner such that it underwent a decrease in height of approximately 50% ($\epsilon$=0.69). In this process, the diameter increased to approximately 120 mm. In a subsequent step, the cylindrical body was upset in a first transverse direction in a manner such that an oval cross section was produced (approximately 30% decrease in cross section). The oval body was then upset by the same amount in the second transverse direction which was perpendicular thereto. These two operations were repeated once more after an intermediate annealing at 1200° C. for 1 h. The forged blank high-temperature worked in this manner was now inserted into the die of a forging press in a manner such that the half forming the root was exposed only to small deformations while the other half forming the bucket blade was gradually deformed in a plurality of operations involving intermediate annealing, via an oval cross section, to produce an aerofoil profile. The bucket blade had the following dimensions:

Width=80 mm

Thickness=25 mm

Profile height=30 mm

Length =200 mm

The forging process was carried out essentially isothermally at a temperature of 1,120° C., a yield point of, on average, 250 MPa being observed. The deformation rate (ram velocity) at the beginning of every forging operation was approximately 0.1 to 0.2 mm/s. After final forging of the bucket blade, the root section was upset further by approximately 20% decrease in height in the longitudinal direction of the bucket. The workpiece was then cooled at a rate of 300° C./h to below 500° C. and after cooling was tempered for 1 h at a temperature of 800° C. The virtually final shape of the turbine bucket except or the milling of the grooves at the fir-tree root was thereby achieved.

Illustrative Example 5

The following alloy was melted under an argon atmosphere in an induction furnace:

Al=48 atomic %

Cr=3 atomic %

Ti=45 atomic %

First, a prismatic ingot of rectangular cross section having a thickness of approximately 40 mm, a width of 90 mm and a length of 250 mm was cast. After the heat treatment in an argon atmosphere at a temperature of 1,100° C. for 10 h, the casting skin was removed by planing and the ingot was encapsulated in soft steel and subjected to high-temperature isostatic pressing for 3 h at 1,260° C. under a pressure of 120 MPa. The first deformation comprised an upsetting (isothermal forging) in the longer transverse direction (edgewise) of approximately 33%, with the result that the ingot assumed an approximately square cross section of approximately 60 mm side length. This operation was carried out at a temperature of 1,150° C. under an argon atmosphere. Then the ingot was hot-rolled in the other transverse direction at the same temperature, in which process it assumed approximately the original rectangular cross-sectional shape, but with reduced dimensions. After an intermediate annealing at 1,200° C. for 1 h under an argon atmosphere, the ingot was deformed by hot rolling (40% decrease in cross section) at 1,050° C. to produce a bar with rectangular profile. During the operations it was possible to observe a high-temperature limit of elasticity of approximately 240 MPa at 1,150° C. The structure of the finished bar was fine-grained and homogeneous. The Vickers hardness HV was increased by approximately 25% compared with the as-cast condition.

Illustrative Example 6

The following alloy was melted under an argon atmosphere in an induction furnace:

Al=48 atomic %
W=3 atomic %
Ge=0.5 atomic %
Ti=48.5 atomic %

A turbine bucket of the following dimensions (turbine blade) was produced from the alloy by casting and high-temperature deformation:

Width=70 mm
Thickness=21 mm
Profile height=26 mm
Length=160 mm

First, a body was cast as a stepped cylinder. The total height was 220 mm, the height of the smaller diameter 120 mm, that of the greater 100 mm, and the diameter 60 mm and 100 mm respectively. The cast blank was annealed at 1,050° C., desurfaced (removal of casting skin) and encapsulated in a soft-steel casing with all-round coverage and subjected to high-temperature isostatic pressing in accordance with the preceding examples. Then the block was first upset in the longitudinal direction at 1,150° C. with a 30% decrease in height and pressed several times in the transverse directions in a manner such that an oval cross section was produced in the blade section. Intermediate annealings at 1,200° C. were carried out. The blank preforged in this manner and having an oval cross section in the blade section was laid in the die of a forging press and deformed in a plurality of stages until the above blade profile was achieved. The forging process was carried out essentially isothermally at a temperature of 1,150° C. A yield point of, on average, 200 MPa was observed at this temperature. The deformation rate (ram velocity) at the beginning of the die forging operations was approximately 0.2 mm/s. The other process steps were analogous to Example 4. The tempering was carried out at a temperature of 750° C. for 2 h. The structure of the finished turbine bucket was fine-grained and homogeneous. The Vickers hardness HV was higher than the as-cast state by 15%.

Numerous other melts with the alloy elements Co, Pd, Mo, Mn, Ta, Nb and Hf were also investigated and their deformability tested. The deformation conditions were essentially the same as specified in the illustrative examples. The most beneficial deformation temperatures were in the range from 1,100° to 1,150° C. The high-temperature yield points observed under these conditions varied between the values of 180 MPa and 260 MPa. The optimum deformation rates (ram velocities) of the forging press were between approximately 0.05 mm/s and 0.2 mm/s, corresponding to values for $\epsilon$ of between $10^{-4}s^{-1}$ and $10^{-2}s^{-1}$.

Effect of the Elements

Adding the elements W, Cr, Mn and Nb individually or in combination by alloying to produce a Ti/Al basic alloy achieved, in all cases, an increase in hardness and strength. In this connection, the effect of combinations (for example Mn+Nb) is the strongest. In general, the increase in hardness is associated with a more or less considerable loss in malleability which can, however, be made good again, at least in part, by adding further elements by alloying which have a toughness-increasing effect.

Adding less than 0.5 atomic % of an element usually has virtually no effect. On the other hand, a certain saturation phenomenon is manifested at approximately 3–4 atomic %, with the result that further additions are pointless or impair the overall properties of the material again.

In conjunction with other elements which increase the strength, B has in general a considerable toughness-increasing effect. Here it was possible to virtually make up for the loss in malleability due to adding W by alloying by adding only 0.5 atomic % of B. Additions higher than 1 atomic % of B are not necessary.

For the further optimization of the properties, polynary systems offer themselves in which attempts are made to make good again the negative properties of individual additions by simultaneously adding other elements by alloying.

The application range of the modified titanium aluminides advantageously extends to temperatures between 600° and 1,000° C.

The invention is not restricted to the illustrative examples.

Quite generally, the process for producing a workpiece from an intermetallic compound of the titanium aluminide TiAl type containing dopant by heat treatment and high-temperature deformation is one which comprises carrying out the following process steps:

Melting the alloy,
Casting the melt to produce a cast body,
Cooling the cast body to room temperature and removing its casting skin and its scale layer,
Subjecting the descaled cast body to high-temperature isostatic pressing at a temperature between 1,200° and 1300° C. and a pressure between 100 and 150 MPa,
Cooling the cast body isostatically pressed at high temperature,
Heating the cooled cast body to temperatures of 1,050° to 1,200° C.,
Deforming one or more times at this temperature for the purpose of molding and structure improvement,
Cooling the deformed cast body to room temperature, and
Machining the deformed cast body to produce the workpiece by material removal.

Advantageously the high-temperature deformation is carried out as follows:

Isothermal deformation of the whole in the temperature range between 1,050° and 1,150° C. at a deformation rate of $\dot{\epsilon}=5\cdot10^{-5}s^{-1}$ to $10^{-2}s^{-1}$ until a deformation of $\epsilon=1.6$ is reached, where $$\epsilon=\ln h_o/h$$

$h_o$=original height of the workpiece,
h=height of the workpiece after deformation.

Preferably this deformation takes place as

Upsetting in the longitudinal direction by 50% decrease in height,
Upsetting in a first transverse direction by 30% decrease in cross section,
Upsetting in a second transverse direction by 30% decrease in cross section,
Upsetting in the longitudinal direction by 20% decrease in height,
Cooling at 300° C./h to below 500° C.,
Tempering at 800° C. for 1 h,
Cooling to room temperature.

In a specific embodiment, the workpiece is forged essentially isothermally, it having the shape of a gas turbine bucket after the isothermal forging. To produce a half-finished product, the workpiece is forged essentially isothermally and, after the isothermal forging, is subjected to a further high-temperature deformation process with up to 40% decrease in cross section, the latter advantageously comprising a hot rolling.

The process is carried out on alloys which have the following composition:

a)
Al=48 atomic %
Zr=3 atomic %
B=0.5 atomic %
Ti=48.5 atomic % b)
Al=48 atomic %
V=3 atomic %
Si=0.5 atomic %
Ti=48.5 atomic % c)
Al=48 atomic %
Cr=3 atomic %
Ti=49 atomic % d)
Al=48 atomic %
Y=3 atomic %
B=0.5 atomic %
Ti=48.5 atomic % e)
Al=48 atomic %
Ge=3 atomic %
Ti=49 atomic % f)
Al=48 atomic %
W=3 atomic %
Ge=0.5 atomic %
Ti=48.5 atomic %

Obviously, numerous modifications and variations of the present invention are possible in the light of the above teachings. It is therefore to be understood that within the scope of the appended claims, the invention may be practiced otherwise than as specifically described herein.

What is claimed as new and desired to be secured by Letters Patent of the United States is:

1. A process for producing a workpiece from an alloy containing dopant and based on titanium aluminide, comprising the following process steps:
melting the alloy into a melt;
casting the metal into a cast body;
cooling the cast body to room temperature and removing casting skin and scale layer on the cast body;
subjecting the descaled cast body to high-temperature isostatic pressing at a temperature between 1,200° and 1,300° C. and a pressure between 100 and 150 MPa;
cooling the isostatically pressed cast body;
heating the cooled cast body to 1,050° to 1,200° C.;
deforming the cast body one or more times for the purpose of molding and structure improvement the high-temperature deformation being carried out by isothermal deformation of the cast body in the temperature range between 1,050° and 1,150° C. at a deformation rate of $\dot{\epsilon}=5\cdot10^{-5}s^{-1}$ to $10^{-2}s^{-1}$ until a deformation of $\epsilon=1.6$ is reached where $$\epsilon=\ln h_o/h$$

$h_o$=original height of the workpiece, and h=height of the workpiece after deformation;
cooling the deformed cast body to room temperature; and
machining the deformed cast body to produce a workpiece by material removal.

2. The process as claimed in claim 1, wherein a TiAl alloy doped with at least one of the elements Zr, V, Cr, Si, Y, W, B or Ge is subjected to the following additional process steps:
melting the alloy in a vacuum or protective-gas induction furnace;
annealing the cast body under a protective gas or in vacuo at a temperature between 1,000° and 1,150° C.;
inserting the cast body, after removing the casting skin and the scale layer, in a soft-steel capsule and sealing the filled steel capsule in an airtight manner;
subjecting the sealed cast body to high-temperature isostatic pressing;
heating the sealed cast body at 10°-50° C./min to 1,050° to 1,150° C.; and
heating the sealed cast body at 1,050°-1,150° C., for 5 to 20 min.

3. The process as claimed in claim 1, wherein the high-temperature deformation is carried out as follows:
upsetting in the longitudinal direction by 50% decrease in height;
upsetting in a first transverse direction by 30% decrease in cross section;
upsetting ni a second transverse direction by 30% decrease in cross section;
upsetting in the longitudinal direction by 20% decrease in height;
cooling the deformed cast body at 300° C./h to below 500° C.;
tempering the deformed cast body at 800° C. for 1 h; and
cooling the deformed cast body to room temperature.

4. The process as claimed in claim 1, wherein the workpiece is forged essentially isothermally and has the shape of a gas turbine bucket after the isothermal forging.

5. The process as claimed in claim 1, wherein the workpiece is forged essentially isothermally and, after the isothermal forging, is subjected to a further high-temperature deformation process with up to 40% decrease in cross section.

6. The process as claimed in claim 1, wherein the alloy has one of the following compositions below Al=48 atomic %
Zr=3 atomic %
B=0.5 atomic %
Ti=48.5 atomic % or

Al=48 atomic %
V=3 atomic %
Si=0.5 atomic %
Ti=48.5 atomic % or

Al=48 atomic %
Cr=3 atomic %
Ti=49 atomic % or

Al=48 atomic %
Y=3 atomic %
B=0.5 atomic %
Ti=48.5 atomic % or

Al=48 atomic %
Ge=3 atomic %
Ti=49 atomic %.

or

Al=48 atomic %
W=3 atomic %
Ge=0.5 atomic %
Ti=48.5 atomic %

7. The process as claimed in claim 5, wherein the high-temperature deformation process comprises a hot rolling.

* * * * *